US008042295B2

(12) United States Patent
Fu et al.

(10) Patent No.: US 8,042,295 B2
(45) Date of Patent: Oct. 25, 2011

(54) UNDERWATER GUN COMPRISING A BARREL ADAPTER INCLUDING A BARREL SEAL

(75) Inventors: Jyun-Horng Fu, Centreville, VA (US); Robert James Howard, Clifton, VA (US); Antonio Paulic, Arlington, VA (US); John W. Rapp, Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 713 days.

(21) Appl. No.: 12/165,066

(22) Filed: Jun. 30, 2008

(65) Prior Publication Data

US 2010/0281728 A1 Nov. 11, 2010

(51) Int. Cl.
*F41C 9/06* (2006.01)

(52) U.S. Cl. ..... 42/1.14; 89/5; 89/31; 114/316

(58) Field of Classification Search ..... 42/1.14; 89/5, 31, 1.809; 114/316
See application file for complete search history.

(56) References Cited

U.S. PATENT DOCUMENTS

| | | | | |
|---|---|---|---|---|
| 5,639,982 | A | 6/1997 | Cipolla | |
| 5,648,631 | A | 7/1997 | Kirschner et al. | |
| 5,687,501 | A | 11/1997 | Stace et al. | |
| 5,746,018 | A | 5/1998 | Kirschner et al. | |
| 5,966,858 | A | 10/1999 | Curtis et al. | |
| 6,305,263 | B1 * | 10/2001 | Wallin | 89/5 |
| 6,701,819 | B1 | 3/2004 | Williams et al. | |
| 7,237,353 | B1 | 7/2007 | Beauchamp et al. | |
| 7,681,352 | B2 * | 3/2010 | Fu et al. | 42/1.14 |
| 7,832,134 | B2 * | 11/2010 | Fu et al. | 42/1.14 |

* cited by examiner

*Primary Examiner* — J. Woodrow Eldred
(74) *Attorney, Agent, or Firm* — DeMont & Breyer, LLC

(57) ABSTRACT

An apparatus and method for sealing the barrel of an underwater gun between firings is disclosed. The apparatus comprises an adapter that attaches to the barrel and includes a physical adaptation that is capable of sealing the barrel. In some embodiments, the physical adaptation is actuated to un-seal the barrel via combustion gases from firing of a round.

17 Claims, 5 Drawing Sheets

UNDERWATER GUN COMPRISING A BARREL ADAPTER INCLUDING A BARREL SEAL

CROSS REFERENCE TO RELATED APPLICATIONS

This case is related to the following U.S. patent application Ser. Nos. 12/165,060 (Underwater Gun Comprising a Valve-Type Barrel-Seal), 12/165,071 (Underwater Gun Comprising a Plate-Type Barrel Seal), 12/165,079 (Underwater Gun Comprising a Passive Fluidic Barrel Seal), and 12/165,090 (Underwater Gun Comprising a Turbine-Based Barrel Seal), all of which were filed on even date herewith and all of which are incorporated by reference herein.

FIELD OF THE INVENTION

The present invention relates to underwater guns.

BACKGROUND OF THE INVENTION

Underwater guns are useful as anti-mine and anti-torpedo devices. Recently, autonomous underwater vehicles (AUVs) have been fitted with underwater guns for torpedo defense and underwater "hunter-killer" CONOPs.

A gun, especially one with a high muzzle velocity, cannot be fired when water is in its barrel. If a firing where to incur in a water-filled barrel, a very high breach pressure would result as the ignited propellant charge forces (or tries to force) the water out of the barrel. The likely result would be material failure of the barrel.

The prior art is replete with approaches for waterproofing the barrel of an underwater gun, or for clearing water from its barrel before firing. U.S. Pat. No. 5,639,982 discloses a means for firing a fully automatic gun underwater using a blank barrel-clearance round. Blank barrel-clearance rounds are alternated with live rounds of ammunition. To begin the process, a blank barrel-clearance round is first detonated. This creates gas and steam within the chamber that forms a bubble at the muzzle end of the barrel, thereby displacing water from the chamber. A live round is then immediately fired. The process is repeated, whereby the subsequent detonation of a blank barrel-clearance round displaces any water that has re-entered the barrel subsequent to the firing of the live round.

U.S. Pat. No. 5,648,631 discloses a spooled tape seal for sealing the barrel of an underwater gun. The system includes a tap that covers the opening of the gun barrel and sprockets for advancing the tape across the opening. Hydrostatic pressure keeps the tape pressed to the end of the barrel to create an effective seal. When a bullet is fired, it perforates the tape. During this brief period of egress, the exhaust gases from combustion of the propellant charge keep water from entering the barrel. Almost immediately, a non-perforated portion of the tape is advanced by the sprockets to cover the barrel opening. External hydrostatic pressure re-seats the tape, thereby preventing water from entering the barrel.

U.S. Pat. No. 5,687,501 discloses a sealing plate for providing a watertight seal for a multi- or single-barreled underwater gun. The sealing plate provides one or more firing apertures in an otherwise solid surface. Between firings, the gun muzzle is sealed by a solid surface of the sealing plate. To fire a bullet, the sealing plate or muzzle rotates to align the gun muzzle with one of the firing apertures. This permits unimpeded egress. After the bullet fires, the plate or muzzle again rotates so that a solid portion of the sealing plate covers the muzzle.

These are but a few of the many patents pertaining to various aspects of underwater gun design in general, and to the water-in-the-barrel problem, in particular. Notwithstanding the many approaches to the problem, no truly satisfactory approach has been developed for keeping water out of the barrel of an underwater gun between and during operation.

SUMMARY OF THE INVENTION

The present invention provides an underwater gun having a barrel seal for preventing water from entering the barrel between the firing of rounds.

In the illustrative embodiment, a barrel adapter couples to the barrel of a gun. A barrel seal is housed in the barrel adapter or otherwise functions in conjunction therewith. The barrel seal has two primary states: one state in which it is "closed" and another state in which it is "open." When the barrel seal is closed, it prevents water from advancing past the seal into the gun's barrel. When the barrel seal is open, it permits a round to be fired.

In one embodiment, the barrel seal comprises a plurality of sealing flaps. Each sealing flap comprises two overlapping plates. Each plate is pivotably attached to an interior wall that defines the bore of the barrel adapter. This pivotable attachment enables each plate to rotate between a first position in which it is substantially perpendicular to the longitudinal axis of the bore (thereby blocking the bore) and a second position in which it is substantially parallel thereto.

The sealing flaps remain closed until forced open due to the increase in pressure in gun as a consequence of the combustion of the chemical propellant in a round that is fired. The increased pressure is sufficient to cause the plates to lie substantially flush against the interior wall of the barrel adapter. Repetitive firing keeps the sealing flaps in the open state.

Each pivotable attachment that attaches the plates of the sealing flaps to the interior wall includes an element that generates a torsional bias that causes the plates to return to the closed state in the absence of increased pressure (i.e., cessation of firing).

In a second embodiment, the barrel seal comprises a plurality of serrations and a stopper round. The serrations extend radially inward from the interior wall of the barrel adapter. The serrations extend over a substantial length of interior wall and are directed toward an outlet end of barrel adapter.

The bore of the barrel adapter is effectively reduced in size by the presence of the serrations to the extent that it has a diameter that is somewhat smaller than the diameter of the stopper round. As a consequence, there will be contact between serrations and the stopper round when the stopper round is fired.

The stopper round comprises an amount of chemical propellant that is insufficient to enable the stopper round to fully transit the serrations within the barrel adapter. Thus, stopper round is trapped (i.e., stopped) by the serrations, thereby sealing the bore of the barrel adapter and, hence, the barrel. A live round is fired to dislodge the stopper round (the pressure rise due to combustion gases in the barrel and barrel adapter dislodges the stopper round). Water is kept out of the bore as firing continues (due to the combustion gases). A subsequent stopper round is fired to reseal the barrel.

In a third embodiment, the barrel seal comprises an electromagnet and a stopper round. The electromagnetic comprises a coil of wire running through the barrel adapter. The stopper round includes a detachable, magnetically attracted tail section.

In operation, the gun's fire-control system sends a signal to a controller at an appropriate time (based on the transit time of the stopper round, the time it takes to energize the electromagnet, etc.) to direct a controlled current source to energize the electromagnet. As the stopper round exits the barrel adapter, a magnetic field that is generated by the electromagnet dislodges the tail section from the stopper round.

The tail section of the stopper round "unfolds" once dislodged. In its unfolded state, the tail section has an enlarged diameter that prevents it from exiting the barrel adapter. The electromagnet remains energized and, as a consequence, the unfolded tail section remains magnetically bound to barrel adapter, thereby sealing the barrel adapter and the gun's barrel. A live round is fired to dislodge the stopper round (the pressure rise due to combustion gases in the barrel and barrel adapter dislodges the stopper round). Water is kept out of the bore as firing continues (due to the combustion gases).

DETAILED DESCRIPTION

The terms appearing below are defined for use in this specification, including the appended claims, as follows:

Axially-oriented (or axial orientation) refers to an orientation that aligns with the longitudinal axis of an element. This orientation is orthogonal to a radial orientation.

Barrel is a narrow, hollow cylindrical portion of a firearm through which a projectile travels.

Bore is the hollow portion of the barrel through which a projectile travels during its acceleration phase.

Breech is an opening in the rear of a barrel of a gun where projectiles can be loaded.

Chamber is the portion of a barrel where a projectile is placed just prior to being fired. This is a high pressure containment area which is very precisely aligned with the bore of the barrel.

Fluidically coupled or fluidic communication means that liquid, gas, or vapor from a first region can flow to or otherwise affect a second region. For example, if two regions are fluidically coupled (or in fluidic communication), a pressure change in one of those regions might result in a pressure change in the other of the regions.

Muzzle is the opening at an end of the barrel where a projectile that has been fired exits the barrel.

Operatively coupled means that the operation of one device affects another device, wherein the devices need not be physical attached to one another. For example, a laser and a mirror are operatively coupled if a laser directs a beam of light to the mirror. An actuator and a valve are operatively coupled if the actuator actuates the valve, regardless of whether there other intermediary mechanisms between the actuator and the valve. Operatively-coupled devices can be coupled through any medium (e.g., semiconductor, air, vacuum, water, copper, optical fiber, etc.) and involve any type of force. Consequently, operatively-coupled objects can be electrically-coupled, hydraulically-coupled, magnetically-coupled, mechanically-coupled, optically-coupled, pneumatically-coupled, thermally-coupled, etc.

Radially-oriented (or radial orientation) refers to an orientation that is coincident with the radial direction of an element. See "axially-oriented."

The present invention pertains to guns that are intended for (1) use in an underwater environment and (2) firing rounds that include a chemical propellant. The underwater guns described herein will typically, although not necessarily, be fitted to AUVs. For clarity, gun 100 is typically depicted in the Figures as having a single round in the chamber or bore. It is to be understood, however, that gun 100 is typically a multi-shot weapon.

Figure 1:
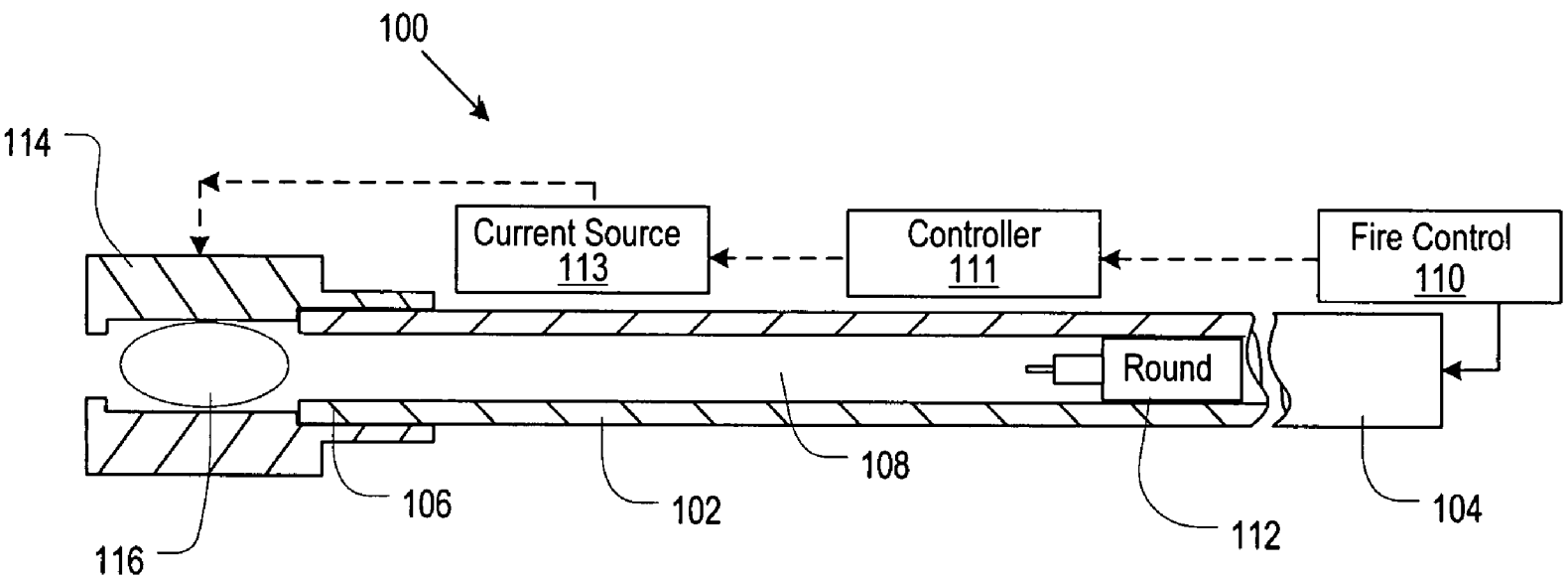
FIG. 1 depicts an underwater gun comprising a barrel adapter including a barrel seal in accordance with the illustrative embodiment of the present invention.

FIG. 1 depicts underwater gun 100 having a barrel seal in a barrel adapter in accordance with the illustrative embodiment of the present invention. Gun 100 includes barrel 102, chamber 104, bore 108, fire-control system 110, optional controlled current source 113, optional controller 111, barrel adapter 114, and barrel seal 116, interrelated as shown. A live round 112 is depicted in bore 108.

Barrel 102, chamber 104, and bore 108 are conventional features of most guns. Fire-control system 110 is basically a computer and ancillary elements that enable gun 100 to hit a target. The relative sophistication of any particular embodiment of fire-control system 110 is primarily a function of the intended application for gun 100. That is, a relatively more sophisticated fire-control system is required for a relatively more autonomous application (e.g., for use in conjunction with an AUV, etc.).

In a typical embodiment, fire-control system 110 interfaces with one or more sensors (e.g., sonar, radar, infra-red search and track, laser range-finders, water current, thermometers, etc.). The sensor input is used to develop a firing solution for a target. To the extent that gun 100 is located on an AUV, etc., fire-control system 110 advantageously takes into account movements of the AUV itself. And, when associated with an AUV, fire-control system 110 is operatively coupled to aiming and firing mechanisms.

The fire-control system is not particularly germane to an understanding of the invention and, furthermore, is well understood by those skilled in the art. As a consequence, fire-control system 110 will not be described in further detail.

Barrel adapter 114, which in the illustrative embodiment is coupled to the muzzle end 106 of barrel 102, includes barrel seal 116. The barrel seal, which is depicted figuratively in FIG. 1, is a physical adaptation (of the barrel adapter) that permits barrel 102 to be temporarily sealed against water intrusion. The barrel seal takes any one of a variety of different forms in various embodiments, a few of which are described later in this specification.

In the illustrative embodiment that is depicted in FIG. 1, muzzle end 106 of barrel 102 and the portion of barrel adapter 114 that abuts the muzzle end are threaded so that they can be "screwed" together. This type of fit permits barrel adapter 114 to be readily removed for maintenance, etc. Alternatively, barrel adapter 114 can be attached to muzzle end 106 of barrel 102 in any convenient manner (e.g., welding, bolted, etc.).

Barrel seal 116 has two primary states: one state in which it is "closed" and another state in which it is "open." When barrel seal 116 is closed, it prevents water from advancing past the seal into barrel 102. When barrel seal 116 is open, it permits round 112 to be fired.

This specification now proceeds with a description of several embodiments of underwater gun 100. These embodiments are distinguished from one another by differences in barrel seal 116.

Figure 2:
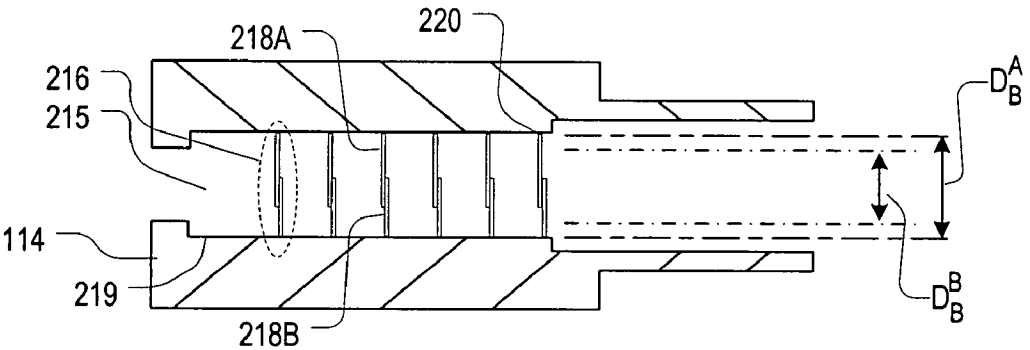
FIG. 2 depicts, via a cross-sectional view, the barrel adapter of FIG. 1 and a first embodiment of a barrel seal. In this first embodiment, the barrel seal comprises a plurality of one-way flaps, each of which flaps comprises two plates that are pivotably coupled to an inner surface of the barrel adapter. The flaps are shown in a sealing state wherein one of the plates in each pair overlies the other plate in the pair.
Figure 3:
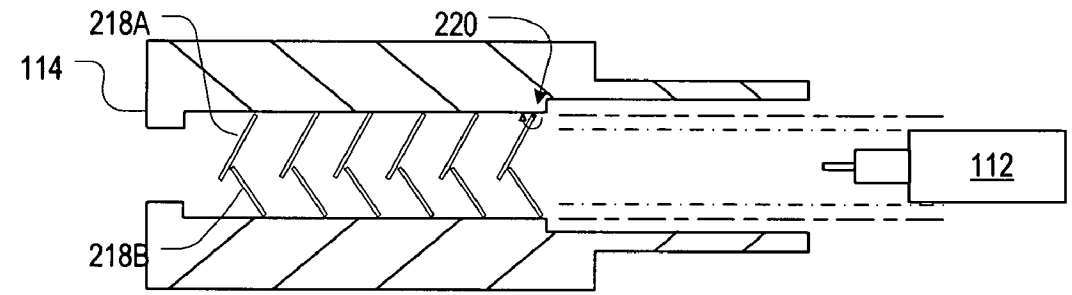
FIG. 3 depicts, via a side cross-sectional view, the barrel adapter and barrel seal of FIG. 2, wherein the plates are partially rotated about their pivot point as the barrel is being unsealed.
Figure 4:
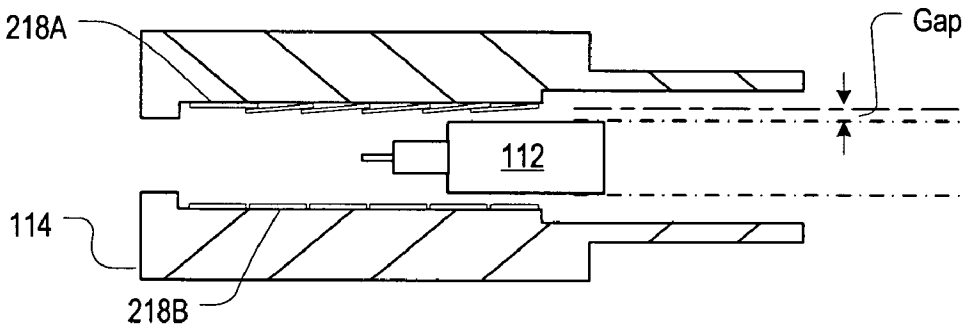
FIG. 4 depicts, via a side cross-sectional view, the barrel adapter and barrel seal of FIG. 2, wherein the plates are fully rotated about their pivot points and lie against the inner surface of the barrel adapter, thereby unsealing the barrel.

FIGS. 2-4 depict an embodiment wherein the barrel seal comprises a plurality sealing flaps 216. In the embodiment that is depicted in these Figures, sealing flaps 216 are regularly arranged within barrel adapter 214. FIG. 2 depicts sealing flaps 216 in a closed state in which they seal barrel 102, thereby preventing water intrusion. FIG. 3 depicts sealing flaps 216 during the process of opening and FIG. 4 depicts sealing flaps 216 when they are fully open.

Referring now to FIGS. 2-4, barrel adapter 114 has bore 215 which is axially-aligned to and concentric with bore 108 of barrel 102 (see FIG. 1). As depicted in FIG. 2, the diameter $D_B^A$ of bore 215 of barrel adapter 114 is greater than the diameter $D_B^B$ of bore 108 of barrel 102. As will become clearer below, the larger bore of barrel adapter 114 accommodates certain structural aspects of the barrel seal.

As depicted in FIG. 2, each sealing flap 216 comprises two overlapping plates 218A and 218B. Each plate is pivotably attached, such as by hinge 220, to interior wall 219 of barrel adapter 114. This pivotable attachment enables each plate to rotate between a position in which it is substantially perpendicular to interior wall 219 (FIG. 2) and a position in which it is substantially parallel to interior wall 219 (FIG. 4).

FIG. 2 depicts sealing flaps 216 in a closed state, wherein plates 218A and 218B partially overlap and are substantially perpendicular to interior wall 219. In this state, the plural sealing flaps provide a barrier that substantially prevents water from entering the barrel.

FIG. 3 depicts sealing flaps 216 in the process of opening. The sealing flaps are forced open due to the increase in pressure in bores 108 and 215 as a consequence of the combustion of the chemical propellant in round 112.

FIG. 4 depicts sealing flaps 216 in a fully open state, wherein plates 218 A and 218B are substantially flush against interior wall 219. In this state, the plates are out of the path of round 112 in the region designated in FIG. 4 as "Gap." This region is created by providing bore 215 with a diameter $D_B^A$ that is larger than diameter $D_B^B$ of bore 108.

Thus, prior to firing round 112, sealing flaps 216 are in their quiescent and closed state, as depicted in FIG. 2. As round 112 fires, the increase in pressure within bore 108 (of barrel 102) and within bore 215 (of barrel adapter 114) due to the combustion of chemical propellant causes plates 218A and 218B to partially rotate or pivot about hinge 220. The pressure is sufficient to cause the plates to lie substantially flush against interior wall 219 of barrel adapter 114. Repetitive firing keeps sealing flaps 216 in the open state.

Hinges 220 include a spring or other element that generates a torsional bias that causes plates 218A and 218B to return to the closed state in the absence of increased pressure (i.e., upon cessation of firing).

Actuation of sealing flaps 216 is effectively "automatic" based on the firing of round 112. It can be readily determined how much time is required for the round to reach barrel adapter 114 and sealing flaps 216 and how much force will be required to cause plates 218A and 218B to rotate with the requisite speed. As a function of the chemical propellant used in the round, the torsional restoring force provided by the spring, etc., the weight of the plates, and other factors, in some embodiments, a separate charge (in addition to the round's chemical propellant) will be required to open sealing flaps 216.

In fact, it is possible that the separate charge will need to be pre-fired (before the live round), so that pressure can build to a sufficient extent to open sealing flaps 216.

Figure 5C:
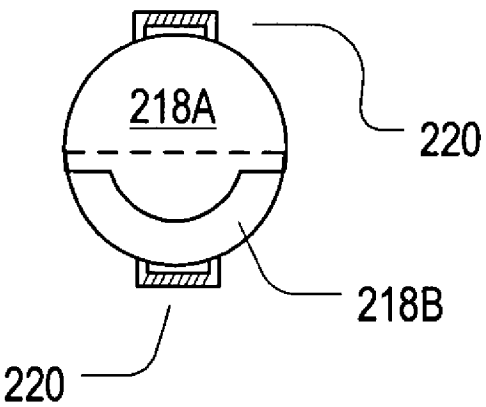
FIG. 5C depicts together, via an end-on view, the plates depicted in FIGS. 5A and 5B, wherein one of the plates overlies the other plate, as in FIG. 2.
Figure 5B:
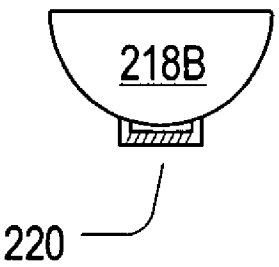
FIG. 5B depicts, via an end-on view, the companion plate to the plate depicted in FIG. 5A.
Figure 5A:
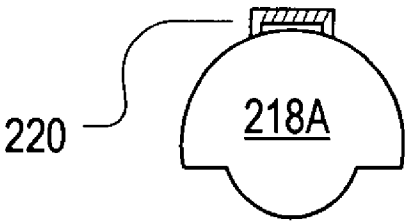
FIG. 5A depicts, via an end-on view, one of the plates in the sealing flap.

FIGS. 5A through 5C depict an embodiment of sealing flap 216 including plate 218A, plate 218B, and hinge 220. FIG. 5A depicts one of the plates, plate 218A and further depicts hinge 220 by which the plate is pivotably coupled to the interior of the barrel adapter. FIG. 5B depicts second plate 218B of sealing flap 216 and its hinge 220. FIG. 5C depicts both of plates 218A and 218B, the plates collectively defining sealing flap 216. In this embodiment, the plates are coupled to diametrically opposed portions of interior wall 219. In the embodiment that is shown in FIGS. 5A through 5C, plate 218A has an area that is somewhat larger than a semicircle and plate 218B has an area of at least a semicircle to ensure that the plates will overlap (when the sealing flap is in the closed position) to prevent water from entering barrel 102.

The use of a plurality of sealing flaps 216, as opposed to a single flap, is to provide redundant seals against the external pressure, which can be significant, as a function of the depth of gun 100 below the water.

Figure 6:
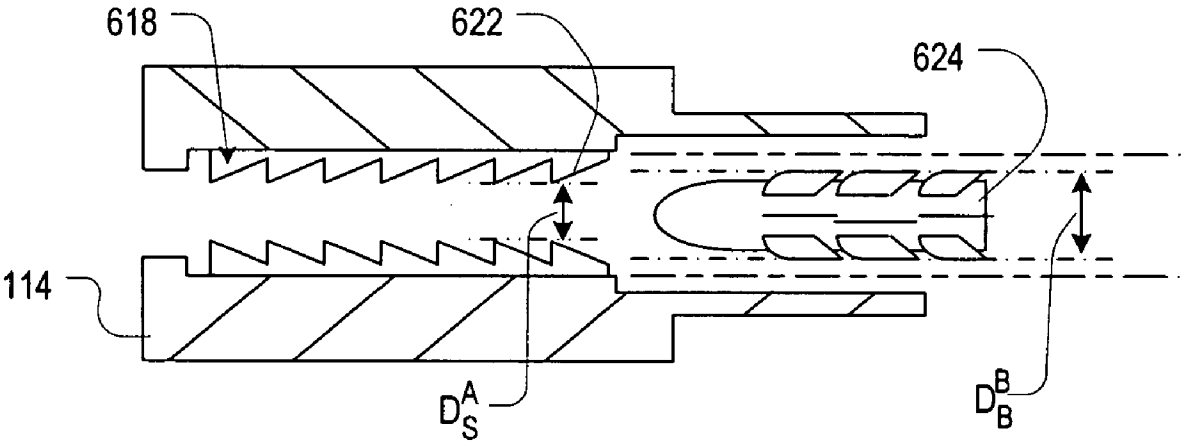
FIG. 6 depicts, via a cross-sectional view, the barrel adapter of FIG. 1 and a second embodiment of a barrel seal. In this second embodiment, the barrel seal comprises a stopper round and plurality of serrations that extend radially inward along a length of the interior of the barrel adapter.
Figure 7:
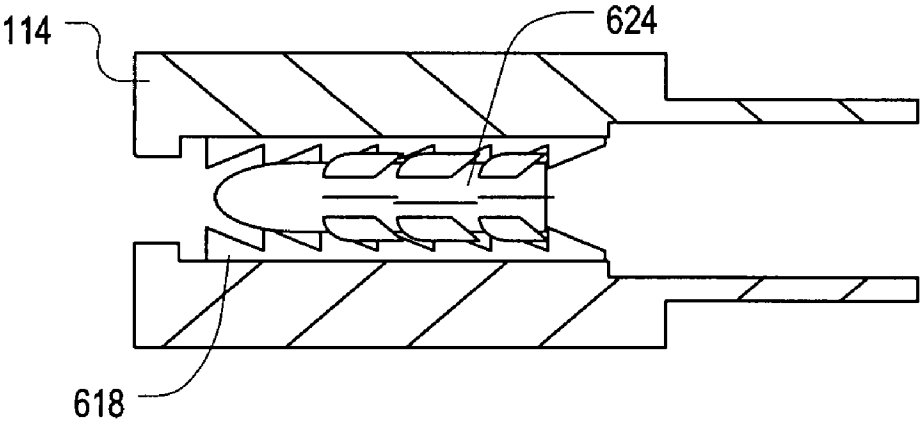
FIG. 7 depicts, via a cross-sectional view, the barrel adapter and barrel seal of FIG. 6, wherein the stopper round has been fired and is captured by the plurality serrations, thereby sealing the barrel.

FIGS. 6 and 7 depict an embodiment wherein the barrel seal comprises a plurality of serrations 618 and stopper round 624.

As depicted in these Figures, serrations 618 extend radially inward from interior wall 219 of barrel adapter 114. The serrations extend over a substantial length of interior wall 219. Serrations 618 are directed toward an outlet end of barrel adapter 114, thereby presenting a series of discrete, inwardly-tapering surfaces 622 to an exiting live round.

The diameter $D_S^A$ of the opening formed by serrations 618 is somewhat smaller than the diameter $D_B^B$ of bore of the barrel or of the diameter of stopper round 624. As a consequence, there will be contact between serrations 618 and stopper round 624 when the stopper round is fired.

Stopper round 624 comprises an amount of charge that is insufficient to enable the stopper round, when fired, to fully transit the serrations within the barrel adapter. Thus, stopper round 624 is trapped by serrations 618.

The serrations are formed from a resilient material, such as a hard rubber, etc., that will permit repeated contact without substantial degradation and will be sufficiently deformable to create an effective water seal in conjunction with a captured stopper round.

In operation, a live round is fired to dislodge stopper round 624 from serrations 618. The pressure increase due the combustion gases (from firing the live round) dislodges the stopper round. Contact with the transiting live round might facilitate removal of the stopper round as well. Water is kept out of the bore as firing continues. A subsequent stopper round is fired to reseal the barrel.

In some embodiments, stopper round 624 is interspersed with live rounds, such as one stopper round per every 20 rounds, etc. In such embodiments, fire-control system 110 would fire 20 rounds and then stop. The twentieth round, being a stopper round, would seal the barrel. If firing is to resume, the next round, which is a live round, would dislodge the stopper round.

Figure 8:
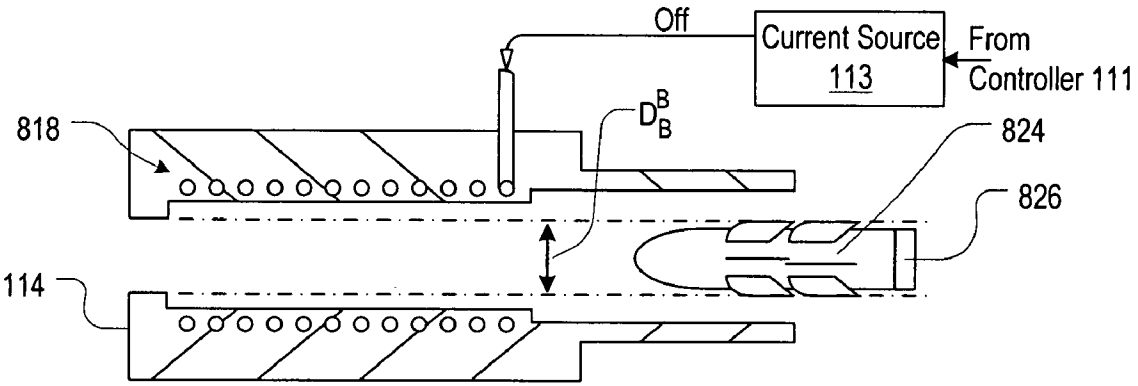
FIG. 8 depicts, via a cross-sectional view, the barrel adapter of FIG. 1 and a third embodiment of a barrel seal. In this third embodiment, the barrel seal comprises an electromagnet and a stopper round.
Figure 9:
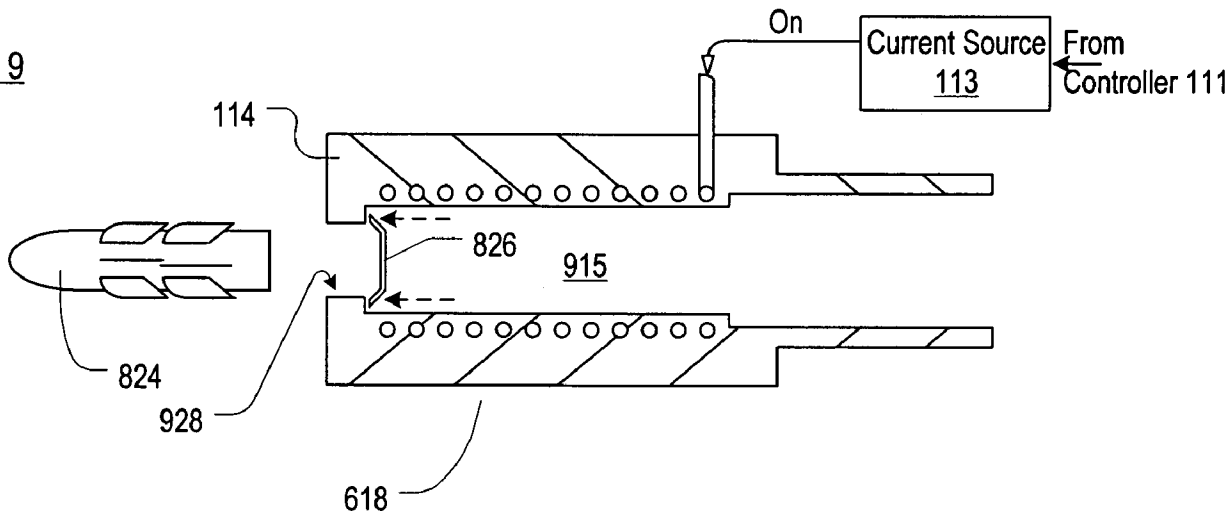
FIG. 9 depicts, via a cross-sectional view, the barrel adapter and barrel seal of FIG. 8, wherein the electromagnet is energized and a detachable tail section of the stopper round is lodged in the barrel adapter.

FIGS. 8 and 9 depict an embodiment wherein the barrel seal comprises an electromagnet and a stopper round.

Electromagnet 818 comprises a coil of wire running through barrel adapter 114. Stopper round 824 comprises a detachable, magnetically attracted, tail section 826.

Electromagnet 818 is coupled to controlled current source 113, which, in turn, is coupled to controller 111. The controller is coupled to fire-control system 110. In the previous embodiments, actuation of the barrel seal is "automatic" in the sense that it is driven by combustion gases. But for the embodiment depicted in FIGS. 8 and 9, the actuation of the barrel seal is responsive to information coming from fire-control system 110.

More particularly, fire-control system 110 sends a signal to controller 111 at an appropriate time to direct controlled current source 113 to energize electromagnet 818. As stopper round 824 exits barrel adapter 114, a magnetic field that is generated by electromagnet 818 dislodges tail section 826 from the stopper round.

Tail section 826 "unfolds" once dislodged from stopper round 824. In its unfolded state, tail section 826 has an enlarged diameter. Barrel adapter 114 has a reduced-size opening 928, relative to bore 915. This reduced-size opening prevents the unfolded tail section 826 from exiting barrel adapter 114. Electromagnet 818 remains energized and, as a consequence, the unfolded tail section remains magnetically bound to barrel adapter 114.

In operation, a live round is fired to tail section 826. The pressure increase due the combustion gases (from firing the live round) dislodges the tail section. Contact with the transiting live round might facilitate removal of tail section 826 as well. Water is kept out of the bore as firing continues.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An underwater gun, comprising:

a barrel, wherein the barrel has a muzzle-end and an axially-oriented first bore;

a barrel adapter that is coupled, at a first end thereof, to the muzzle end of the barrel, wherein:

(a) the barrel adapter comprises an axially-oriented second bore;

(b) the first bore and the second bore are concentric;

(c) the barrel adapter comprises a physical adaptation that, in a first state, prevents water from entering the barrel and, in a second state, enables a round to transit the barrel adapter; and (d) the actuating force that places the physical adaptation in the second state comprises an increase in pressure in the barrel.

2. The underwater gun of claim 1 wherein the physical adaptation is a plurality of sealing flaps disposed along a length of the second bore of the barrel adapter.

3. The underwater gun of claim 2 wherein the second bore is defined by a cylindrical wall, and wherein each sealing flap comprises two plates that are joined to the cylindrical wall by a pivotable attachment that permits partial rotation of the plates.

4. The underwater gun of claim 3 wherein the plates in each sealing flap are substantially semi-circular.

5. The underwater gun of claim 4 wherein at least one plate in each sealing flap has an area that is larger than a semi-circle so that the plates in each sealing flap overlap.

6. The underwater gun of claim 3 wherein the second bore has a second radius that is larger than a first radius of the first bore.

7. The underwater gun of claim 3 wherein the pivotable attachment comprises an element that imparts a torsional bias that causes the plates to return to the first state when pressure in the barrel decreases.

8. The underwater gun of claim 3 wherein the two plates that define each sealing flap attach to diametrically-opposed portions of the cylindrical wall.

9. The underwater gun of claim 1 wherein the physical adaptation comprises:

a plurality of serrations that extend radially inward along a length of the second bore of the barrel adapter; and a stopper round, wherein the stopper round comprises an amount of charge that is insufficient to enable the stopper round, when fired, to transit the serrations within the barrel adapter, wherein the serrations frictionally engage the stopper round to prevent transit.

10. The underwater gun of claim 9 wherein the serrations are directed toward an outlet end of the barrel adapter, thereby presenting a series of discrete, inwardly-tapering surfaces to an exiting round.

11. The underwater gun of claim 1 wherein the physical adaptation comprises:

an electromagnet; and a stopper round, wherein the stopper round comprises a detachable tail section, wherein, when the electromagnet is energized and the stopper round is fired, the tail section is magnetically pulled from the stopper round and lodges in the second bore as the stopper round transits the barrel adapter.

12. An underwater gun, comprising:

a barrel, wherein the barrel has a muzzle-end and an axially-oriented first bore; and a barrel adapter that is coupled, at a first end thereof, to the muzzle end of the barrel, wherein:

(a) the barrel adapter comprises an axially-oriented second bore that is defined by a cylindrical wall;

(b) the first bore and the second bore are concentric;

(c) a plurality of sealing flaps are disposed along a length of the second bore;

(d) each sealing flap comprises two plates that are joined to the cylindrical wall by a pivotable attachment that permits partial rotation of the plates; and (e) the plates within each sealing flap are sized so that they overlap to seal the barrel.

13. The underwater gun of claim 12 wherein the plates in each sealing flap are substantially semi-circular.

14. The underwater gun of claim 12 wherein the pivotable attachment comprises an element that imparts a torsional bias that causes the plates to return to the first state when pressure in the barrel decreases.

15. The underwater gun of claim 12 wherein the two plates that define each sealing flap attach to diametrically-opposed portions of the cylindrical wall.

16. An underwater gun, comprising:

a barrel, wherein the barrel has a muzzle-end and an axially-oriented first bore; and a barrel adapter that is coupled, at a first end thereof, to the muzzle end of the barrel, wherein:

(a) the barrel adapter comprises an axially-oriented second bore that is defined by a cylindrical wall;

(b) the first bore and the second bore are concentric;

(c) a plurality of serrations that extend radially inward along a length of the second bore of the barrel adapter; and (d) a stopper round, wherein the stopper round comprises an amount of charge that is insufficient to enable the stopper round, when fired, to transit the serrations within the barrel adapter, wherein the serrations frictionally engage the stopper round to prevent transit.

17. The underwater gun of claim 16 wherein the serrations are directed toward an outlet end of the barrel adapter, thereby presenting a series of discrete, inwardly-tapering surfaces to an exiting round.

* * * * *